United States Patent [19]

Wass

[11] 4,407,239

[45] Oct. 4, 1983

[54] ROTARY ENGINE

[76] Inventor: Richard G. Wass, 781 Rancho Simi Dr., Covina, Calif. 91724

[21] Appl. No.: 252,847

[22] Filed: Apr. 10, 1981

[51] Int. Cl.[3] ..... F02B 57/06

[52] U.S. Cl. ..... 123/44 C; 123/44 D

[58] Field of Search ..... 91/493; 123/44 R, 44 C, 123/44 D, 44 E

[56] References Cited

U.S. PATENT DOCUMENTS

| | | | |
|---|---|---|---|
| 1,170,783 | 2/1916 | Stedman | 123/44 C |
| 1,452,572 | 4/1923 | Prosser | 91/493 X |
| 1,705,130 | 3/1929 | McKlusky | 123/44 D |
| 2,399,486 | 4/1946 | Harries | 123/44 D |
| 3,517,651 | 6/1970 | Graybill | 123/44 C |

FOREIGN PATENT DOCUMENTS

| | | | |
|---|---|---|---|
| 39302 | 3/1907 | Switzerland | 123/44 R |

*Primary Examiner*—Michael Koozo

*Attorney, Agent, or Firm*—Jack C. Munro

[57] ABSTRACT

An internal combustion rotary engine in which only a single spark plug is utilized to ignite fuel/air mixture located within a single cylinder. Within the cylinder is located a pair of pistons mounted in a back-to-back relationship. A power output shaft is attached to the cylinder. The pistons connect with a connecting shaft assembly which extends through an access opening assembly formed within the cylinder. The cylinder is rotatably mounted within the fixed engine housing. The connecting shaft assembly connects with an auxiliary power output shaft. An appropriate fuel/air inlet port is provided within the fixed engine housing and there is also provided an exhaust port. Each piston incurs a power stroke for each single rotation of the cylinder.

9 Claims, 5 Drawing Figures

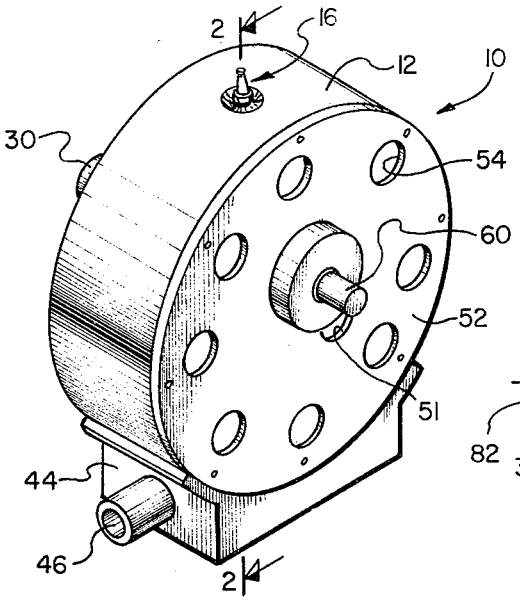
Fig. 1.
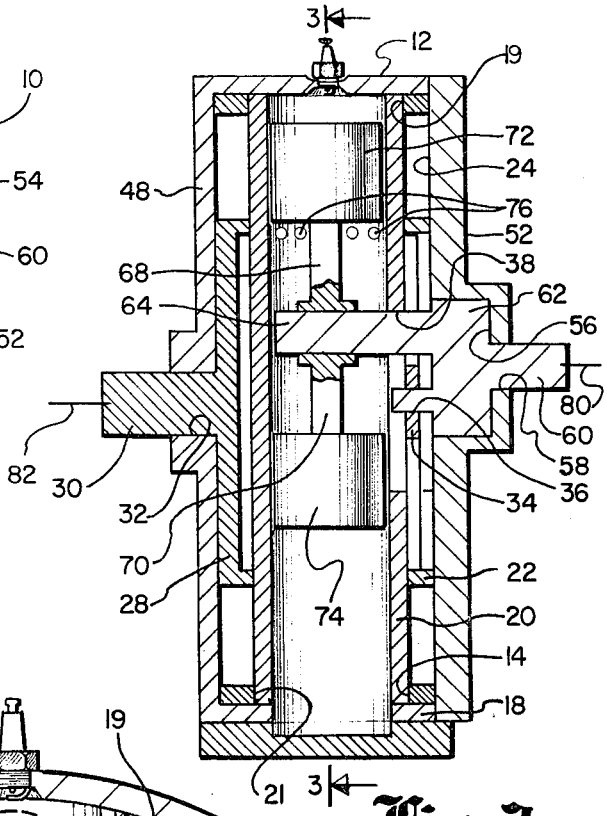
Fig. 2.
Fig. 3.
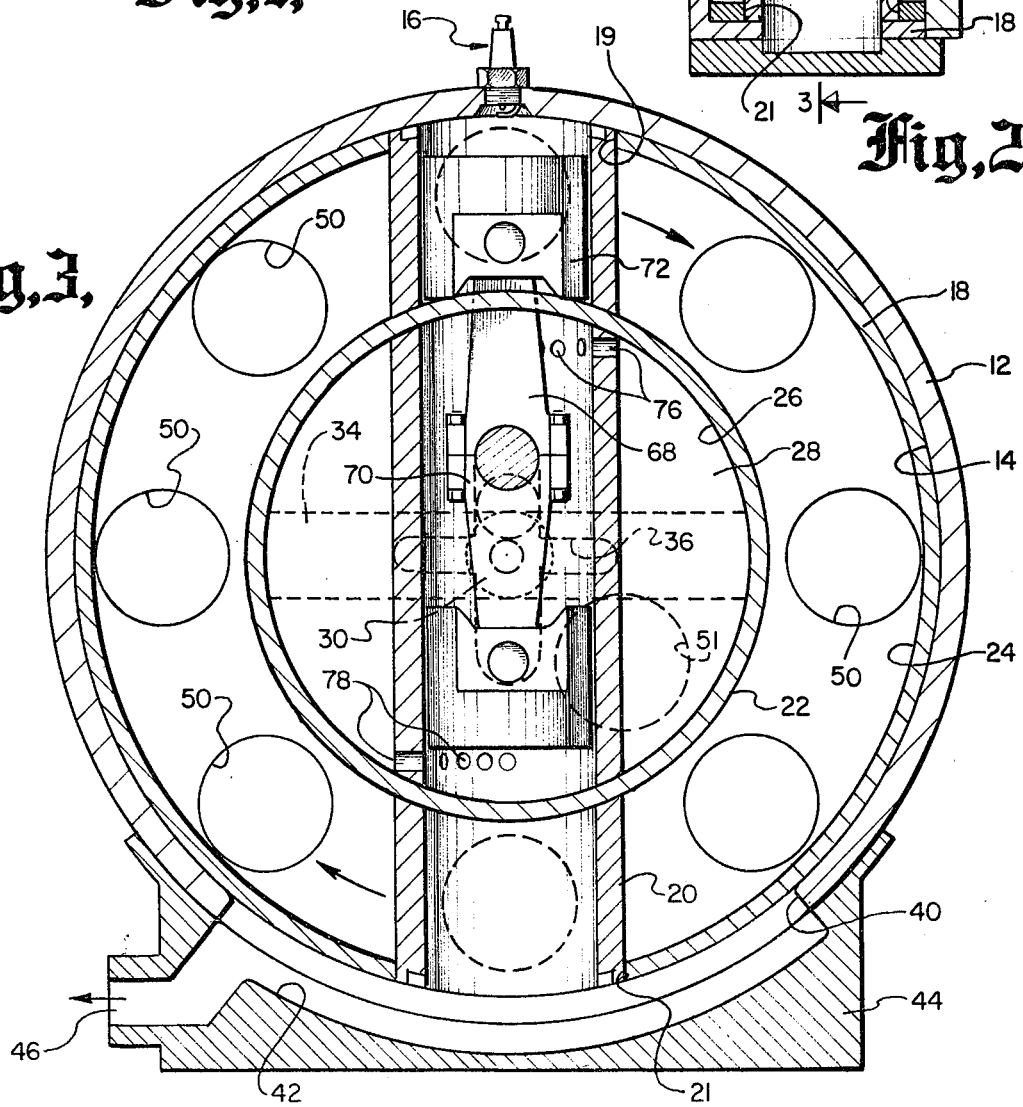

ROTARY ENGINE

BACKGROUND OF THE INVENTION

The field of this invention relates to engines and more particularly to a rotary engine which is to be more efficient in the producing of power.

Many prior attempts have been made to design a rotary engine which is compact, simple in design and capable of generating useful amounts of power. In the vast majority of cases, these prior attempts have proved fruitless and the resultant engines have been quite complex in design and inefficient in operation. These prior failures are due in part to the employment of a complex, non-symmetrical, cam arrangements, and like mechanical means which detrimentally add to the imbalance of the engine and itso ultimate inability to resist wear in its moving parts.

There is a need to design an engine which overcomes the above objectives and transforms energy into useful power at a high rate of efficiency.

SUMMARY OF THE INVENTION

The rotary engine of the present invention takes the form of a fixed engine housing which has a cylindrical internal chamber. Within the cylindrical internal chamber there is rotatably mounted a rotor. A spark plug for combusting of fuel/air mixture at the appropriate time is mounted in a specific location within the engine housing and connects with the internal chamber. The cylinder housing includes a pair of aligned, diametrically opposed openings. Within the cylinder there is movably mounted a pair of pistons mounted in a back-to-back relationship. The cylinder is fixed onto a power output shaft. This power output shaft extends transversely from the cylinder housing and exteriorly of the engine housing. An access opening arrangement is formed within the cylinder to accommodate movement of a connecting shaft assembly during operation of the engine of this invention. The connecting shaft assembly connects to the pair of pistons and is rotated by the reciprocal movement of the pistons. The connecting shaft assembly will function as an auxiliary output shaft which extends exteriorly of the engine housing. Each piston is to incur a power stroke with each revolution of the rotor. An appropriate fuel/air inlet port and an appropriate exhaust port is provided within the engine housing.

BRIEF DESCRIPTION OF THE DRAWING

FIG. 1 is an exterior, perspective view of the rotary engine of this invention;

FIG. 2 is a cross-sectional view through the engine of FIG. 1 showing the novel piston and cylinder arrangement within this invention taken along line 2—2 of FIG. 1;

FIG. 3 is a cross-sectional view through the engine of this invention taken along line 3—3 of FIG. 2 showing one of the pistons at the initiation of the a power stroke;

DETAILED DESCRIPTION OF THE SHOWN EMBODIMENT

Figure 4:
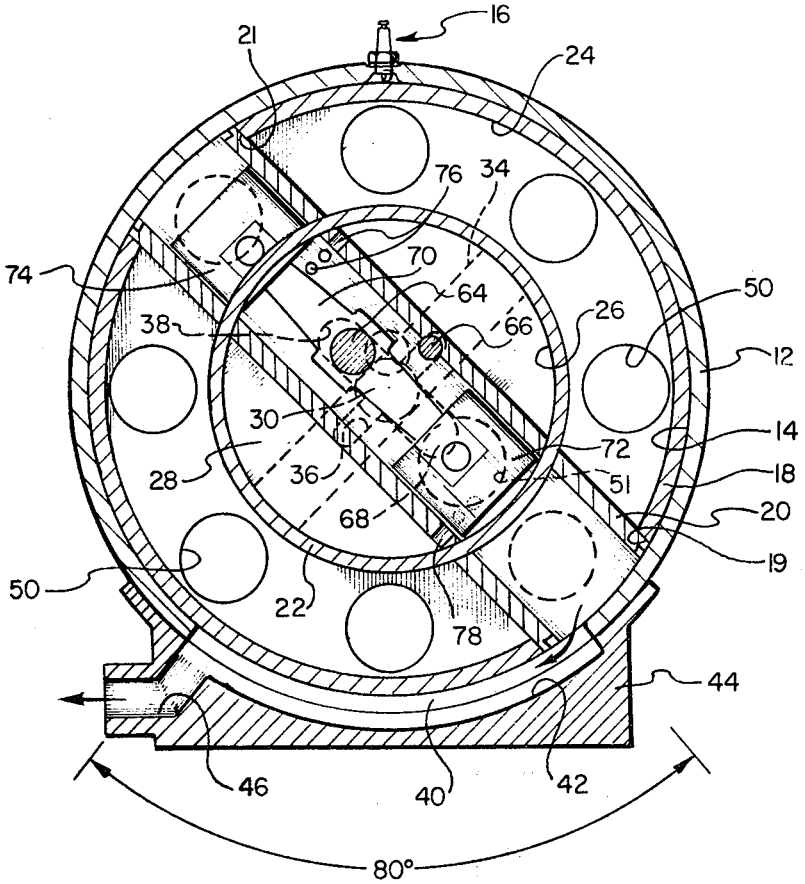
FIG. 4 is a view similar to FIG. 3 but showing the cylinder housing rotated approximately one hundred and twenty degrees from the position shown within FIG. 3.
Figure 5:
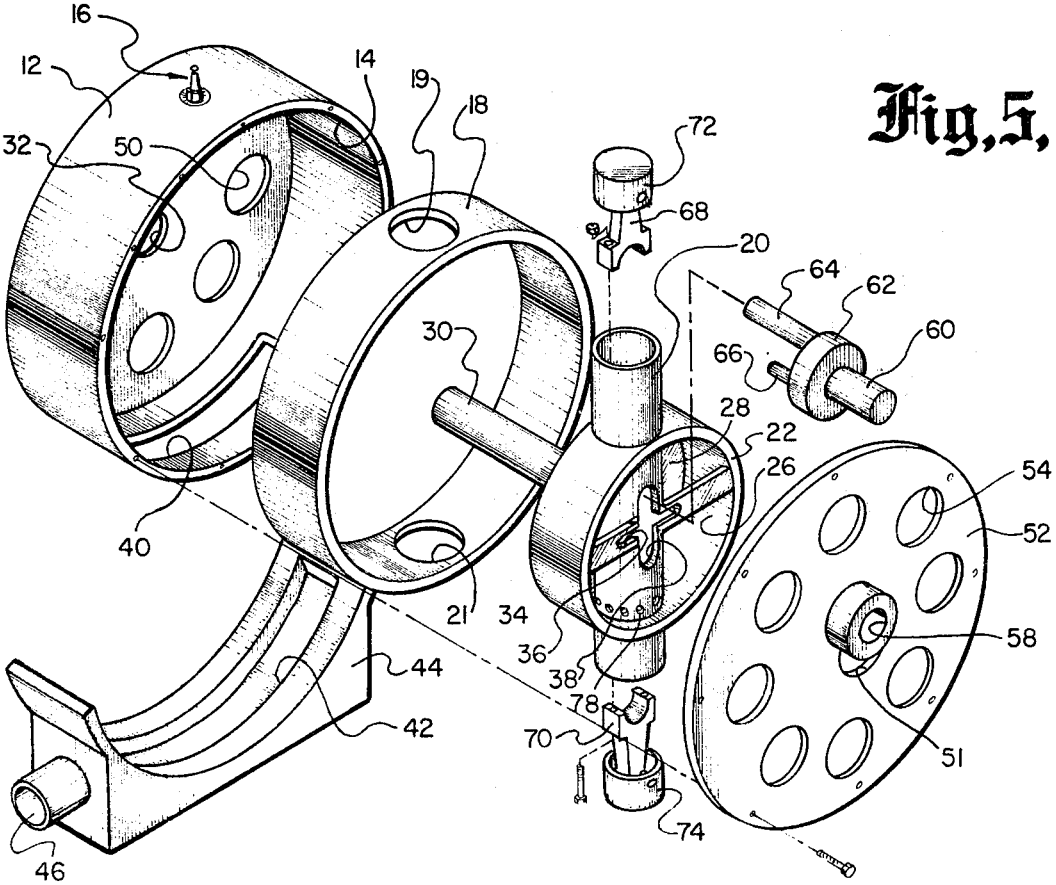
FIG. 5 is an exploded isometric view of the rotary engine of this invention.

Referring particularly to the drawing, there is shown the rotary engine 10 of this invention. The engine 10 includes a fixed engine housing 12 which has a cylindrical, internal chamber 14. A single spark plug assembly 16 is mounted within the engine block 12. Spark plug assembly 16 is deemed to be conventional.

Within the internal chamber 14 there is located in a rotative, but close-fitting arrangement, a rotor 18. The rotor 18 is basically in the shape of a ring. Diametrically located within the rotor 18 are a pair of openings 19 and 21. Mounted between the openings 19 and 21 is a cylinder 20. The cylinder 20 is open ended. It is to be noted that the rotor 18 is open at both the front and back, so in essence, the rotor 18 is formed of a segment of the side wall of a cylinder.

The cylinder 20 is fixedly secured to, and passes centrally through, a ring 22. It is to be noted that the diameter of the ring 22 is substantially smaller than the diameter of the rotor 18 so that the exterior of the ring 22 is spaced from the inner wall of the rotor 18. This spacing between the exterior of the ring 22 and the interior wall of the rotor 18 forms a cooling chamber 24.

The interior of the ring 22 forms an interior chamber 26. The interior chamber 26 is to function as a portion of the fuel/air inlet port assembly to be described further on in the specification. The fuel/air mixture is to enter chamber 26 from a source (not shown) through opening 51. The backside of the ring 22 is closed by a plate 28. The exterior surface of the plate 22 has centrally attached thereto a primary output shaft 30. The primary output shaft 30 extends exteriorly of the housing 12 through opening 32 formed therein.

Located across the front side of the ring 22 and secured to the cylinder 20 is a crossbar 34. Formed within the crossbar 34 is an elongated slot 36. A similar elongated slot 38 is formed through the sidewall of the cylinder 20. The slots 36 and 38 are located so their longitudinal center axes are perpendicular. Also, each of the slots 36 and 38 connect with each other. The function of the slots 36 and 38 will also be explained further on in the specification.

Formed through a portion of the sidewall of the housing 14 is an outlet port 40. With respect to the center of the housing 14, the length of the port 40 is approximately eighty degrees. The port 40 connects with exhaust opening 42 and exhaust manifold 44. The exhaust port 42 connects with exhaust opening 46 through which exhaust gases are to be discharged into the ambient.

The backside of the engine housing 12 is closed by means of a back plate 48. The opening 32 is formed within the back plate 48. Also formed within the back plate 48 are a plurality of cooling openings 50. Each of the cooling openings 50 (eight in number) connect with cooling chamber 24.

The front side of the engine housing 12 is closed by means of a front plate 52. Formed within the front plate 52 are a series of cooling openings 54 (eight in number). The cooling openings 54 also connect with the cooling chamber 24. The function of the openings 50 and 54 are to permit air to flow through the chamber 24 to facilitate cooling of the engine 10 of this invention.

Centrally formed within plate 52 is an internal recess 56. Centrally conducted through the walls of the recess 56 is a hole 58. Through the hole 58 there is conducted an auxiliary shaft 60. The shaft 60 is fixedly secured to a disc 62. The disc 62 closely conforms and is located within the recess 56.

Attached to the backside of the disc 62 are a pair of connecting shafts 64 and 66.

The shaft 64 is of substantially larger diameter than the shaft 66. The shaft 64 is to be located in a close fitting manner within the slot 38. Similarly, the shaft 66 is to be located in a close fitting manner within the slot 36. Therefore, it is deemed to be apparent that the width of the slot 36 is substantially less than the width of the slot 38.

The shaft 64 functions as a wrist pin for the piston rods 68 and 70 by being connected therebetween. Pivotal action between the wrist pins 68 and 70 by the connecting shaft 64 is permitted.

Fixedly secured to the outer ends of the piston rod 68 is a piston 72. Similarly, a piston 74 is fixedly secured to the outer end of the piston rod 70. Both the pistons 72 and 74 are movable within the cylinder 20.

Formed through the sidewall of the cylinder 20 are a plurality of holes 76. Referring particularly to FIG. 3 of the drawings, it can be seen that the holes 76 are located directly adjacent the piston 72 and also are positioned on the right hand side of the cylinder 20. This cylinder 20 revolves clockwise, as shown in FIG. 3. The reason the holes 76 are located on the right hand side with respect to the direction of rotation of the cylinder 20, is that there will be a natural tendency for the fuel/air mixture located within the interior chamber 26 to be conducted through the holes 76. Therefore, with the pistons 72 in the bottom dead center position, the fuel/air mixture is to be conducted through the holes 76 to within the portion of the cylinder 20 located outwardly or above the piston 72.

In a similar manner, formed through the sidewall of the cylinder 20 are a series of openings 78 which are to function to conduct fuel/air mixture to within the cylinder 20 located above or outward from the piston 74.

The operation of the rotary engine of this invention is as follows: Referring particularly to FIG. 3, the piston 72 shown incurring the beginning of the power stroke. This is due to the fuel/air mixture being ignited within the space outward or above the piston 72. The ignition of the fuel/air mixture is caused by the spark plug assembly 16.

The power stroke of the piston 72 causes the piston 72 to be moved within the cylinder 20. This causes the connecting shaft 64 to be moved within the slot 38. As a result, the disc 62 (as well as the auxiliary output shaft 60) is rotated about the axis 80. Also, the entire cylinder 20, ring 22 and the rotor 18 are also rotated due to the rotation of the connecting shaft 64. This rotation is about axis 82. It is to be noted that as such rotates, the connecting shaft 66 is guided within the slot 36. The purpose of the shaft 66 is to stabilize the rotational movement in order to diminish undesirable rotational torques.

As the piston 72 proceeds through its power stroke, the piston 74 is finishing discharge of the combusted fuel/air mixture through the ports 40, 42, and through exhaust opening 46. As the power stroke of the piston 72 continues, fuel/air mixture is now permitted to enter through the port 78 to within the cylinder 20 above the piston 74. This entry of fuel/air mixture facilitates the substantially complete exhaust of the combusted gases from above the piston 74.

After the cylinder 20 has rotated approximately forty five degrees, the fuel/air mixture now located above the piston 74 is not permitted to escape. Further revolving movement of the cylinder 20 results in compressing of the fuel/air mixture and upon the piston 74 getting into the position of piston 72 shown in FIG. 3, the spark plug assembly 16 is again fired and piston 74 is then ready to begin its power stroke.

During the time of the compression stroke of the piston 74 as previously described, the power stroke of the piston 72 has been completed and the chamber located above the piston 72 is now connected with the exhaust ports 40 and 42. Continual movement of the cylinder 20 results in the combusted gases being discharged through these ports 40 and 42 and out through discharge opening 46. The piston 72 then begins the fuel/air intake and proceeds through the compression stroke.

It is to be understood that operation of the engine 10 of this invention results in the primary output torque to be supplied through the shaft 30. Auxiliary power output is to be transmitted through the shaft 60. The shaft 60 will revolve two revolutions for every revolution of shaft 30.

What is claimed is:

1. A rotary engine comprising:

a fixed engine housing having an internal chamber, said internal chamber having an inner wall, said internal chamber being cylindrical and having a longitudinal center axis;

a cylinder each end of which is open, said ends of said cylinder being located within said internal chamber in a close fitting manner, said cylinder being rotatable on a first axis of rotation relative to said fixed engine housing, said first axis of rotation coinciding with said longitudinal center axis of said fixed engine housing;

a primary output shaft attached to said cylinder and extending exteriorly of said fixed engine housing, the rotational axis of said primary output shaft coinciding with said first axis of rotation;

a pair of opposing pistons being movably mounted within said cylinder, said pair of opposing pistons being connected together about a connecting shaft assembly, said connecting shaft assembly extending exteriorly of said internal chamber and including an auxiliary power output shaft, said auxiliary power output shaft having a second axis of rotation, said second axis of rotation being spaced from said first axis of rotation, said connecting shaft assembly extending through an access opening assembly within said cylinder;

fuel/air mixture firing means mounted within said engine housing, each said end of said cylinder to be positionable directly adjacent said fuel/air mixture firing means;

an inlet port assembly including an interior chamber formed within said engine housing for conducting of a fuel/air mixture into said cylinder, said interior chamber being totally confined within said internal chamber and centrally disposed about said longitudinal center axis, said interior chamber being spaced from said inner wall; and an outlet port assembly formed within said engine housing for discharging of exhaust gases from said cylinder.

2. The rotary engine as defined in claim 1 wherein:

said inlet port assembly including an opening arrangement formed through the side wall of said cylinder, said opening arrangement comprising a first series of openings and a second series of openings, said first series of openings being located substantially diametrically opposite said second series of openings, said first series of openings being located directly adjacent one of said ends of said cylinder with said second series of openings being located directly adjacent the other of said ends of said cylinder, both said first and said second series of openings being located within said interior chamber.

3. The rotary engine as defined in claim 2 wherein:

said cylinder being mounted within a ring, said ring to be spaced from the wall of said internal chamber, said ring enclosing said interior chamber.

4. The rotary engine as defined in claim 1 wherein:

said interior chamber being concentrically disposed relative to said internal chamber.

5. A rotary engine comprising:

a fixed engine housing having an internal chamber, said internal chamber being cylindrical and having a longitudinal center axis;

a cylinder each end of which is open, said ends of said cylinder being located within said internal chamber in a close fitting manner, said cylinder being rotatable on a first axis of rotation relative to said fixed engine housing, said first axis of rotation coinciding with said longitudinal center axis of said fixed engine housing;

a primary output shaft attached to said cylinder and extending exteriorly of said fixed engine housing, the rotational axis of said primary output shaft coinciding with said first axis of rotation;

a pair of opposing pistons being movably mounted within said cylinder, said pair of opposing pistons being connected together about a connecting shaft assembly, said connecting shaft assembly extending exteriorly of said internal chamber and including an auxiliary power output shaft, said auxiliary power output shaft having a second axis of rotation, said second axis of rotation being spaced from said first axis of rotation, said connecting shaft assembly extending through an access opening assembly within said cylinder;

fuel/air mixture firing means mounted within said engine housing, each said end of said cylinder to be positionable directly adjacent said fuel/air mixture firing means;

an interior chamber assembly including an inlet port formed within said engine housing for conducting of a fuel/air mixture into said cylinder;

an outlet port assembly formed within said engine housing for discharging of exhaust gases from said cylinder; and said access opening assembly comprising a pair of slots located in a crossed relationship, said connecting shaft assembly including a pair of connecting shafts continuously in engagement with said access opening assembly.

6. The rotary engine as defined in claim 5 wherein:

the longitudinal center axes of said slots being perpendicular to each other, one of said connecting shafts being in continuous engagement with one of said slots while the other of said connecting shafts is in continuous engagement with the other of said slots.

7. A rotary engine comprising:

a fixed engine housing having an internal chamber, said internal chamber being cylindrical and having a longitudinal center axis;

a cylinder each end of which is open, said ends of said cylinder being located within said internal chamber in a close fitting manner, said cylinder being rotatable on a first axis of rotation relative to said fixed engine housing, said first axis of rotation coinciding with said longitudinal center axis of said fixed engine housing;

a primary output shaft attached to said cylinder and extending exteriorly of said fixed engine housing, the rotational axis of said primary output shaft coinciding with said first axis of rotation;

a pair of opposing pistons being movably mounted within said cylinder, said pair of opposing pistons being connected together about a connecting shaft assembly, said connecting shaft assembly extending exteriorly of said internal chamber and including an auxiliary power output shaft, said auxiliary power output shaft having a second axis of rotation, said second axis of rotation being spaced from said first axis of rotation, said connecting shaft assembly extending through an access opening assembly within said cylinder;

fuel/air mixture firing means mounted within said engine housing, each said end of said cylinder to be positionable directly adjacent said fuel/air mixture firing means;

an inlet port assembly including an inlet port formed within said engine housing for conducting of a fuel/air mixture into said cylinder;

an outlet port assembly formed within said engine housing for discharging of exhaust gases from said cylinder;

said inlet port assembly including an opening arrangement formed through the side wall of said cylinder, said opening arrangement comprising two spaced-apart series of openings;

said cylinder being mounted within a ring, said ring to be spaced from the wall of said internal chamber said ring having an interior chamber, said interior chamber being part of said inlet port assembly adapted to receive fuel/air mixture from said inlet port, said opening arrangement connecting with said interior chamber; and said access opening assembly comprising a pair of slots located in a crossed relationship, said connecting shaft assembly including a pair of connecting shafts continuously in engagement with said access opening assembly.

8. The rotary engine as defined in claim 7 wherein:

the longitudinal center axis of said slots being perpendicular to each other, one of said connecting shafts being in continuous engagement with one of said slots while the other of said connecting shafts is in continuous engagement with the other of said slots.

9. The rotary engine as defined in claim 8 wherein:

for each revolution of said primary output shaft said auxiliary output shaft makes two in number of revolutions.

* * * * *